United States Patent [19]

DeBlock et al.

[11] Patent Number: 4,872,498

[45] Date of Patent: Oct. 10, 1989

[54] VENTING DOOR LIGHT WITH INSULATED GLASS

[75] Inventors: David A. DeBlock; Kert E. Artwick, both of Holland, Mich.

[73] Assignee: ODL, Incorporated, Zeeland, Mich.

[21] Appl. No.: 103,393

[22] Filed: Oct. 1, 1987

[51] Int. Cl.[4] ..... E06B 3/32

[52] U.S. Cl. ..... 160/90; 49/456; 49/407; 49/406

[58] Field of Search ..... 160/90; 49/456, 406, 49/407, 408

[56] References Cited

U.S. PATENT DOCUMENTS

| | | |
|---|---|---|
| 1,073,160 | 9/1913 | Newpher . |
| 1,129,042 | 2/1915 | Malmberg . |
| 1,150,755 | 8/1915 | Frey et al. . |
| 1,171,444 | 2/1916 | Larson et al. . |
| 1,171,445 | 2/1916 | Larson . |
| 1,203,311 | 10/1916 | Connell . |
| 2,386,151 | 10/1945 | Trautvetter . |
| 2,760,609 | 8/1956 | Hagerty . |
| 2,791,007 | 5/1957 | Kobil et al. . |
| 2,993,242 | 7/1961 | Leisibach . |
| 2,996,767 | 8/1961 | Kobil et al. . |
| 3,081,503 | 3/1963 | Mendelsohn ..... 160/90 X |
| 3,184,801 | 5/1965 | Fletcher . |
| 3,750,358 | 8/1973 | Lewkowitz . |
| 3,975,881 | 8/1976 | Ninowski, Jr. . |
| 4,280,309 | 7/1981 | Huelsekopf . |
| 4,407,100 | 10/1983 | Huelsekopf . |
| 4,523,408 | 6/1985 | McConnell . |
| 4,553,361 | 11/1985 | Ralph . |
| 4,569,154 | 2/1986 | Bayer . |
| 4,570,399 | 2/1986 | Wentink . |

*Primary Examiner*—Blair M. Johnson

*Attorney, Agent, or Firm*—Warner, Norcross & Judd

[57] ABSTRACT

The specification discloses a door light providing improved drainage, improved sealing between sashes, and improved sealing between frame components. Brackets are mounted on the sill at discrete locations to hold the screen and the movable sash off the sill to provide drainage and eliminate capillary action which would otherwise draw moisture to the frame interior. The meeting rails include resiliently deflectable interlock flanges which engage and are biased against one another when the movable sash is closed to improve the seal therebetween. A frame trim piece interfits with the frame body and deflects a resiliently deformable flap integral with the frame body to effect a weather seal between the trim piece and frame body.

12 Claims, 4 Drawing Sheets

VENTING DOOR LIGHT WITH INSULATED GLASS

BACKGROUND OF THE INVENTION

The present invention relates to windows and more particularly to door lights, which are windows adapted for installation in door blanks.

A door light provides a window assembly in a door. Present constructions are of two basic types-ventilating and fixed. A ventilating door light includes a movable window sash to selectively permit the passage of air therethrough. A fixed door light supports only stationary window glass. Fixed door lights are preferred in relatively cold climates because of the better seal and insulation provided by the fixed glazing. Ventilating door lights are often preferred in warmer climates wherein insulation is not as significant a consideration.

Known ventilating door lights have several characteristics making their use in colder climates undesirable. First, water is often drawn to the interior side of the frame by the capillary action between the closed movable sash and the sill. Second, the screens in ventilating door lights rest directly on the sill and thereby impede proper water drainage. Third, ventilating lights can permit undesirable infiltration of air about the movable sash and/or between the interfitting frame components.

SUMMARY OF THE INVENTION

The aforementioned problems are overcome in the present invention, wherein an insulated, weather-sealed ventilating door light is provided for relatively cold climates.

In a first aspect of the invention, the window or light includes a plurality of sill-mounted brackets spaced at discrete locations along the length of the sill. Each bracket includes a first spacing portion for holding the screen above the sill and a second spacing portion for holding the sash above the sill even when the sash is in the closed position. The spacing distance is adequate to prevent water being drawn by capillary action from between the sash and the sill and/or from between the screen and the sill. The elimination of capillary action also improves water drainage from under the sash and screen.

In a second aspect of the invention, the window includes a frame prohibiting water from entering the core of the door blank. Specifically, the frame includes two side-rail assemblies each of which comprises two separate parts. A first part is a nonapertured side extending the full depth of the window frame; and the second part is a separate locking bar secured to the frame body and defining notches cooperating with the latches on the movable sash to hold the movable sash in desired positions. Because only the locking bar is notched, the nonapertured frame body prohibits water from entering the core of the door blank through the side assemblies.

In a third aspect of the invention, the window includes an improved meeting rail construction for the fixed and movable sashes. Each meeting rail includes a resiliently deflectable flange extending the full length of the rail. The flanges are arranged to engage, deflect, and be biased against one another as the movable sash is closed to effect an improved weather seal between the two sashes. This further prohibits the infiltration of water and/or air through the junction of the two sash assemblies.

In a fourth aspect of the invention, the frame includes integral structure for sealing the frame trim pieces to the remainder of the frame assembly. More specifically, the frame includes a co-extruded, resiliently deformable flange which is compressed by the frame trim pieces when mounted on the frame. This integral seal facilitates manufacture of the light and provides an effective air and water seal about the perimeter of the door light without the need for separate glazing compound.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
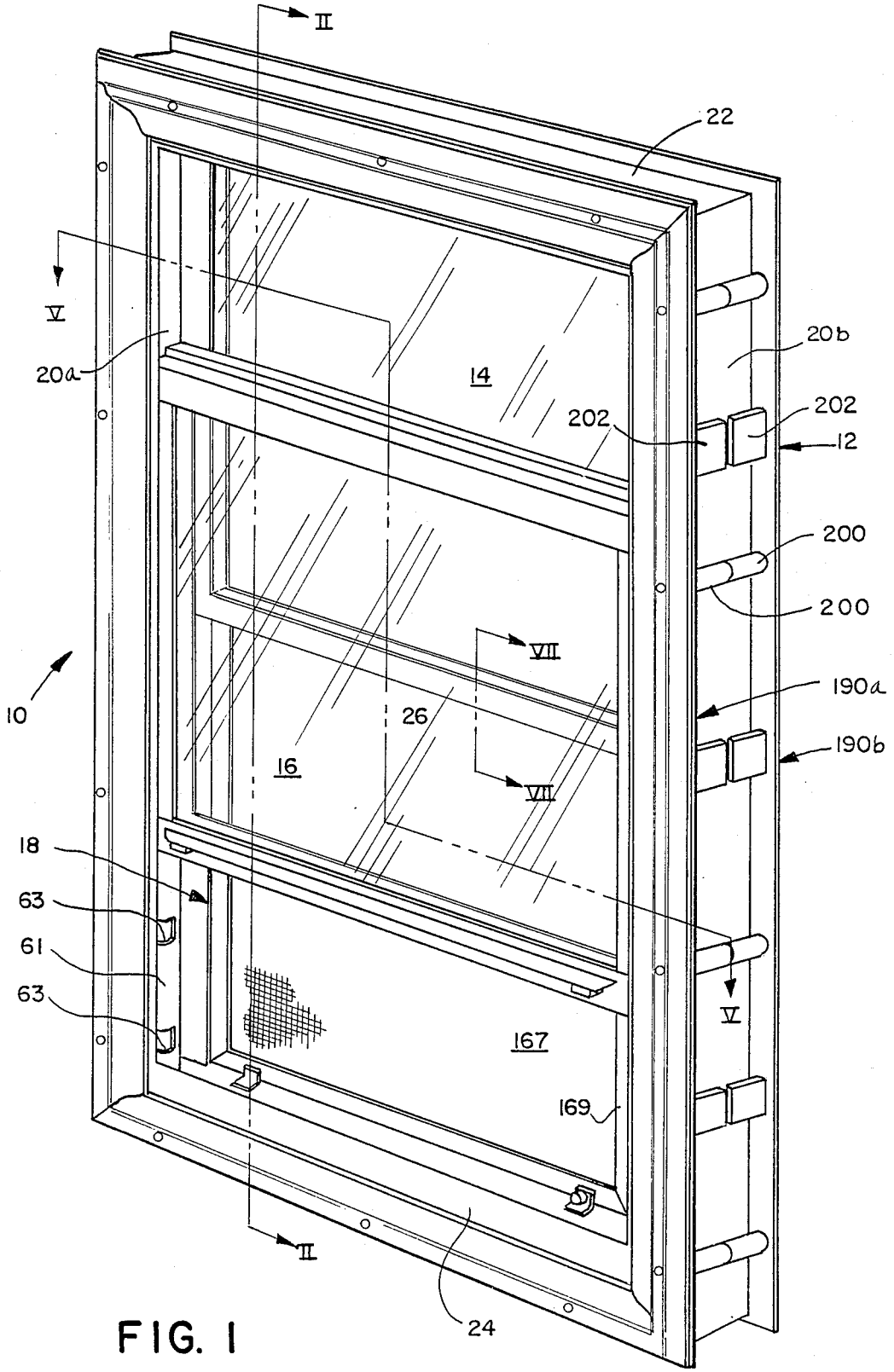
FIG. 1 is a perspective view of the present ventilating light.

A ventilating door light constructed in accordance with a preferred aspect of the invention is illustrated in FIG. 1 and generally designated 10. The door light includes a frame assembly 12, a fixed panel 14, a moving sash assembly 16, and a screen 18. The fixed panel 14 is integrally supported by the frame 12; and the screen 16 is removably supported by the frame 12 generally coplanar with the fixed panel. The movable sash assembly 16 is slidably supported by the frame 12 and is movable between a lower or closed position and upper or open positions.

The frame 12 (FIG. 1) includes a pair of side rail assemblies **20*a* and 20*b*, a top rail 22, a sill 24, and a fixed meeting rail 26. The side rail assemblies 20, the top rail 22, and the sill 24 are interconnected to define a rectangular frame. The joints between these components are all butt joints. The fixed meeting rail 26 also extends between and is fixedly secured to the side rail assemblies 20**.

Figure 5:
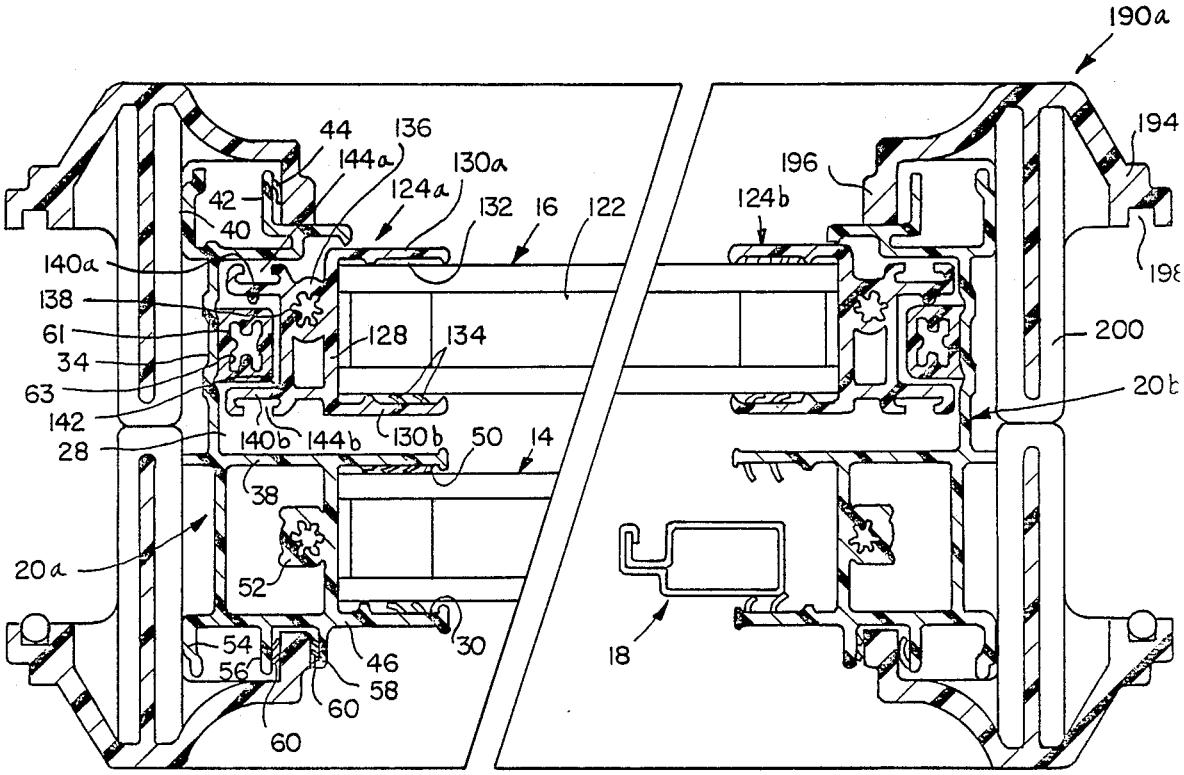
FIG. 5 is a fragmentary sectional view taken along plane V—V in FIG. 1.
Figure 6:
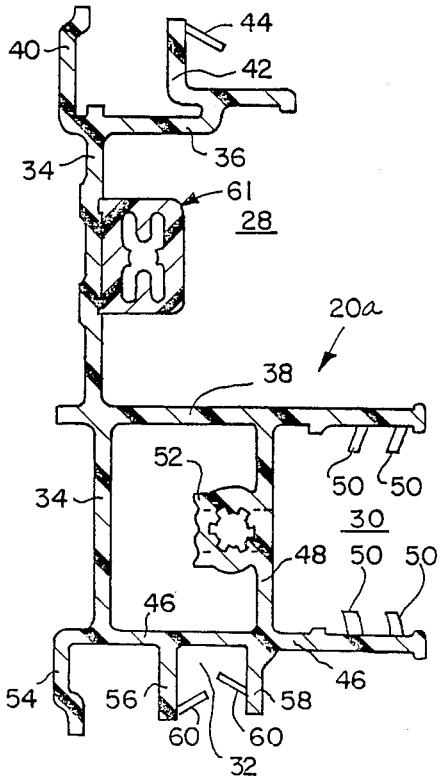
FIG. 6 is a sectional view of the extrusion illustrated in FIG. 4.

Both of the side rail assemblies 20 (FIGS. 1, 5, and 6) are extrusions generally uniform in cross section throughout their lengths. The cross-sectional shape of the left side rail **20*a* is illustrated in FIG. 6; and the right side rail 20*b* is the mirror image thereof. The side rail 20*a* defines a sliding sash channel 28, a fixed panel channel 30, and a trim piece receiving channel 32. The sliding sash channel 28 includes a floor 34 and a pair of sides 36 and 38 extending generally perpendicularly from the floor. A pair of spacing channels 40 and 42 are generally parallel one another and extend from the side flange 36 to receive the interior frame trim piece as will be described. A resiliently deformable coextruded flap 44 extends from the flange 42 to seal the interior frame piece against the side rail as will be described. An exterior wall 46 extends generally perpendicularly from the base wall 34. The middle wall 38, the exterior wall 46, and a floor 48 extending therebetween define the U-shaped fixed glass channel 30. A pair of coextruded flaps 50 are coextruded with each of the walls 38 and 46 to extend into the channel 30 to provide a weather seal against the fixed panel again as will be described. The connecting wall 48 supports an integral screw boss 52 for receiving screws or other threaded fasteners at the corner of the frame 12. Spacer walls 54, 56, and 58 are generally parallel to one another and extend in a common direction from exterior wall 46 to support the exterior frame trim piece as will be described. One integral flap 60 is coextruded with the side rail 20***a* and extends into the channel 32 to seal the exterior trim piece within the side rail.

In the preferred embodiment, all described coextruded flaps are coextruded with the body or piece from which they extend and have a durometer significantly lower than the remainder of the body or piece. Other integral sealing means could also be used such as a flap extruded with the associated body, but having a reduced cross-sectional area to provide the desired deformability.

Figure 4:
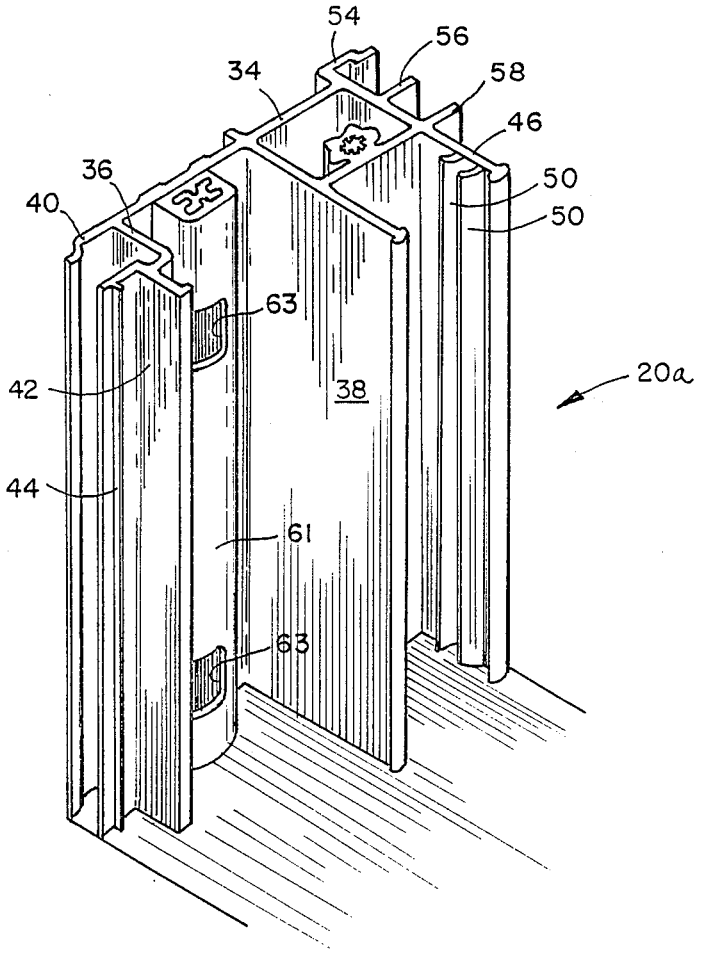
FIG. 4 is a fragmentary perspective view of the left side frame body extrusion.

A locking bar 61 (FIGS. 4–6) is secured to each of the side rails 20 and more specifically within the sash channel 28. The locking bar 61 is an extrusion having a generally uniform cross section throughout its length. The locking bar is secured to the bottom wall 34 of the side rail 20 using adhesive and/or back-stapling. The locking bar 61 includes notches or cut-outs 63 at spaced locations along the height of the locking bar to receive the latch mechanism 162 to maintain the movable sash 16 at any one of a variety of positions.

The sill 24 (FIGS. 2 and 3) is also an extrusion having a uniform cross section throughout its length. The sill 24 includes a sill wall 62 which is angled downwardly from the interior sill wall 64 to the exterior sill wall 66 to facilitate drainage of water from the sill. The interior wall 64, the exterior wall 66, and the intermediate wall 68 are all generally parallel to one another. Interior wall 64 extends upwardly and downwardly from the sill wall 62; while the exterior and intermediate walls 66 and 68 extend only downwardly from the sill wall. Reinforcing ribs 70 are included on the underside of the sill wall for strength and structural integrity. The upper portion of the interior wall 64 defines a channel 72 opening toward the movable sash 16 to carry the pile weather seal 74 providing a weather seal thereagainst. A sealing flap 76 extends generally perpendicularly from a lower portion of the interior wall 64 and carries a coextruded resiliently deformable flap 78 to seal the interior frame piece as will be described. Similarly, a sealing flange 80 extends generally perpendicularly from a lower portion of the exterior wall 66 and integrally carries a coextruded flap 82 to seal against the exterior frame piece. The seal wall 62, the exterior wall 66, and the sealing flange 80 define a U-shaped channel 84 to receive a portion of the exterior frame piece. One coextruded flap 82 extends into the channel 84 from each of the sill wall 62 and the sealing flange 80 to provide a weather seal against the exterior frame piece.

The top rail 22 (FIG. 2) is also an extrusion having a generally uniform cross section throughout its length. The top rail includes a body wall 86 and a pair of fixed panel supporting walls 88*a* and 88*b* extending generally perpendicularly therefrom. An intermediate wall 90 interconnects the walls 88 at a point offset from the body wall 86 for structural integrity. The walls 88 and the intermediate wall 90 together define a glazing channel 92 for supporting the fixed glazing panel. Coextruded flaps 94 extend into the glazing channel 92 from both of the walls 88 to provide a weather seal between the walls and the fixed gazing panel. A pair of spacing flanges 96 extend upwardly from the body wall 86 at generally opposite ends thereof to space the interior and exterior frame trim pieces. Integral coextruded flaps 98 extend downwardly from opposite ends of the body wall 86 to seal against the interior and exterior frame trim pieces.

The fixed meeting rail 26 (FIGS. 2 and 7) and the moving meeting rail 100 (FIG. 7) are generally identical to one another. The fixed meeting rail 26 includes a body portion 102 and a pair of side walls 104*a* and 104*b* extending upwardly therefrom to define a channel 106. A pair of integral coextruded flaps 108 extends into the channel 106 from each of the side walls 104 to seal against the fixed glazing panel 14. The body 102 includes an integral channel 110 which supports a pile weather seal (not shown) to seal against the moving meeting rail 100. An integral L-shaped interlock 112 extends from the body portion 102 and includes a support flange 114 and a deflectable flange 116 oriented generally perpendicularly to one another. The deflectable flange 116 is generally planar and generally parallel to the side walls 104 of the channel 106 and therefore is generally parallel to the plane of the window. The terminal portion 118 of the deflectable flange 116 is beveled to facilitate the engagement and deflection of the cooperating interlocking flanges. Additionally, the terminal edge 120 of the deflectable flange 116 is angled away from the side walls 104 to further improve the interengagement of the interlocking flanges. The deflectable flange 116 is preferably five, and most preferably ten, times as wide as it is thick to enhance its deflectability. The fixed meeting rail 26 is secured between the side rails 20 by inserting screws or other threaded fasteners (not shown) through the side rails 20 and into the screw channel 103 of the meeting rail 26.

Figure 2:
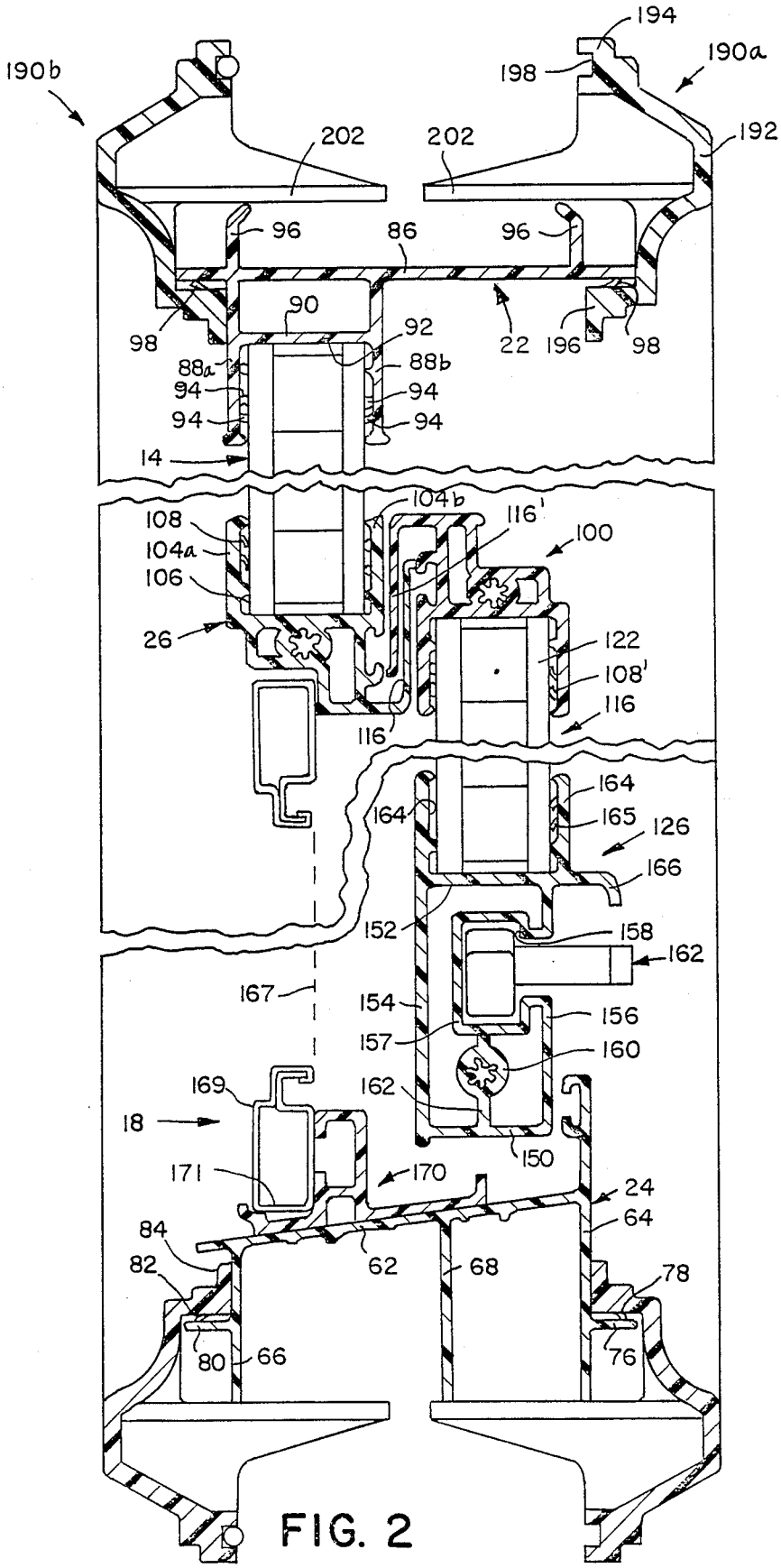
FIG. 2 is a sectional view taken along plane II—II in FIG. 1.
Figure 3:
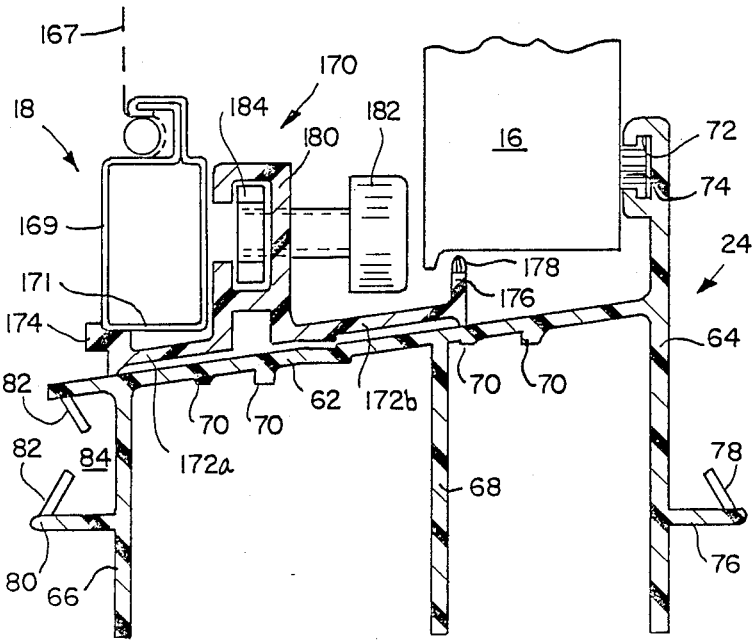
FIG. 3 an enlarged view of the sill assembly with the frame trim pieces removed.

The fixed glazing panel 14 is of conventional construction. In the preferred embodiment, the panel 14 is $\frac{5}{8}$-inch thickness insulating glass. The panel 14 is received within the channel 30 on either side rail (FIG. 5), in channel 92 of the top rail 22 (FIG. 2), and in channel 106 in the fixed meeting rail 26 (FIG. 2). The panel 14 is inserted into the channels during fabrication of the frame 12. As the panel 14 is forced into each channel, the coextruded flaps associated with the channel are deflected and are thereby biased against the panel 14 to provide an integral weather seal thereagainst without the need for separate glazing compound. The inclusion of two such flaps on each channel side wall is to further improve the weather seal.

The lower sash 16 is also generally well known to those having ordinary skill in the art and will not be described in detail. Suffice it to say that the lower sash (FIGS. 2 and 5) includes $\frac{5}{8}$-inch thickness insulating glass 122 entrapped within a rigid vinyl surround including a pair of side rails 124*a* and 124*b* (FIG. 5), a meeting rail 100 (FIG. 2), and a pull rail 126 (FIG. 2). The members of the lower sash surround are intersecured by screws or other threaded fasteners secured within the various screw channels 160 (FIG. 2), 103' (FIG. 7), and 136 (FIG. 5). Adhesive or heat welding can also be utilized to intersecure these pieces.

The side rail 124*a* (FIG. 5) is an extrusion having a uniform cross section throughout its length. The member includes a bottom wall 128 and a pair of side walls 130*a* and 130*b* extending generally perpendicularly therefrom to define a channel 132 therebetween. Two coextruded flaps 134 extend inwardly from each side wall 130 to seal the glazing panel 122 within the side member 124. The side member 124 further includes a screw boss 136 and a second bottom wall 138 generally parallel to the body wall 128. A pair of side walls 140*a* and 140*b* extend generally perpendicularly from the bottom wall 138 to define a channel 142 therebetween. Channels 144*a* and 144*b* open opposite one another from side walls 140*a* and 140*b*, respectively, to receive pile weather seals (not shown).

Figure 7:
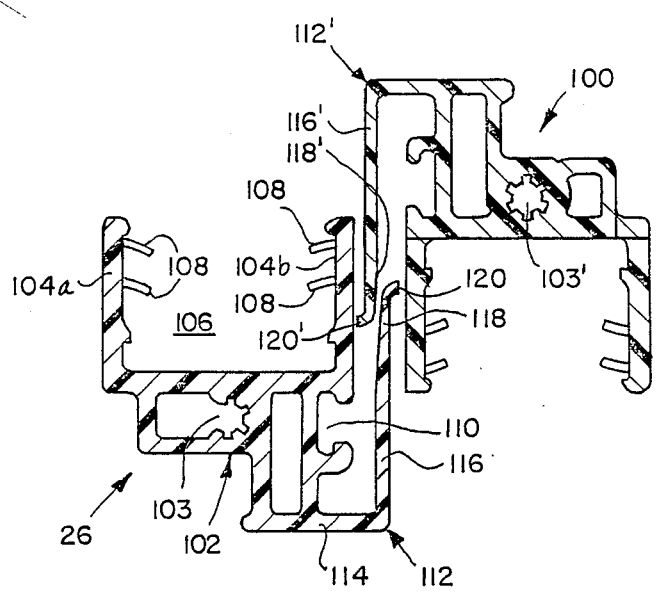
FIG. 7 is a sectional view taken along plane VII—VII in FIG. 1.

The meeting rail 100 (FIGS. 2 and 7) is generally identical to fixed meeting rail 26 (see also FIG. 7). Suffice it to say that meeting rail 100 includes an interlock flange 112′ including a deflectable flange 116′ with a beveled terminal portion 118′ and an angled edge portion 120′.

The pull rail 126 (FIG. 2) is an extrusion having a uniform cross section throughout its length. The extrusion includes a floor wall 150, a top wall 152, an exterior wall 154, and an interior wall 156 defining an integral latch channel 158. The bottom wall 150 and the top wall 152 are generally parallel to one another. A screw channel 160 is supported by a wall 162 extending between the bottom wall 150 and the latch channel wall 157. A conventional spring-loaded latch 162 is mounted at either end of the latch channel 157 for engagement with the frame side rails 20. A side wall 164 extends upwardly from the top wall 152 so that the side wall, the top wall, and the exterior wall 154 together define a glass channel 164. The interior portion 166 of the top wall 152 is angled slightly downwardly to provide a lift flange easily engagable by the fingers to lift and lower the sash 16.

The screen 18 is of conventional construction and includes fiberglass or aluminum screening 167 within a frame or surround 169 preferably fabricated of aluminum. The lower edge 171 of the screen 18 is proximate the frame sill 24 in the assembled window.

The sill brackets or screen-stop assemblies 170 (FIGS. 2–3) support both the movable sash 16 and the screen 18 above the wall 62 of the sill 24. Each assembly 170 includes a screen-stop or bracket 171 cut from an extrusion having the cross section illustrated in FIGS. 2 and 3. Each bracket is approximately $\frac{5}{8}$ inch wide. The bracket includes a floor or base 172*a* and b from which extends upwardly a screen support leg 174 and a sash support leg 176. The screen support leg 174 is L-shaped in cross section including a generally horizontal base to support the screen and a vertical leg to provide a vertical registration surface to maintain the lower edge of the screen in a desired plane. The sash support leg 176 includes a terminal edge 178 which is coextruded of a different and lower durometer than the remainder of the bracket 170 to provide a slight cushion for the movable sash 16. A screw-support body 180 extends upwardly from the base 172 intermediate support legs 174 and 176. The support body 180 is generally C-shaped in cross section opening toward the screen 16. A nylon thumb screw 182 is threadably carried within the screw support body 180 and/or a nut 184 entrapped within the body 180 to selectively engage the screen surround 169 and entrap the screen surround between the thumb screw and the leg 174.

The interior frame trim piece 190*a* and the exterior frame trim piece 190*b* (FIGS. 1–2 and 5) are generally identical to one another. Each includes a fluted body portion 192 terminating in an outboard leg 194 and an inboard leg 196. The outboard leg 194 defines a caulking groove 198 opening toward the opposite frame trim piece. A plurality of screw bosses 200 extend inwardly toward a screw boss from the opposite frame trim piece; and opposite bosses abut one another in the assembled unit to properly space the frame trim pieces from one another. Additionally, positioning legs 202 extend inwardly toward the positioning legs on the opposite frame trim piece to properly orient the frame trim pieces with respect to the side rails 20, the top rail 22, and the sill 24.

All extrusions of the preferred embodiment are fabricated of polyvinyl chloride (PVC or vinyl) wherein the body portions have a durometer of 86D and the coextruded deformable flaps have durometer of 80A. Of course, other suitable materials could be substituted for the described extruded vinyl.

ASSEMBLY AND OPERATION

The following described assembly of the window 10 assumes that all described extrusions are available and have been cut to the proper lengths.

The lower sash 16 is fabricated by joining the side members 124 with the meeting rail 100 and the pull rail 126. As above described, each joint in the surround of the sash 16 is a butt joint; and the pieces are interconnected by passing screws through the pieces and into the described screw channels. As the insulated glass 122 is entrapped within the surround, the integral coextruded flaps 134 (FIG. 5), 108′ (FIG. 2) and 165 (FIG. 2) are deflected and/or compressed to provide a weather-tight seal between the glazing panel 122 and the surround members. The latches 162 are mounted within the latch channel 158 in conventional fashion to complete assembly of the lower sash 16.

Prior to assembly of the window frame 12, a locking bar 61 must be secured in the lower half of the sash channel 28 of each frame side rail 20. The locking bar is preferably secured in position by both using an adhesive and inserting staples into the back of the locking bar 61 through the base wall 34 of the side rail 20.

The frame 12 is assembled entrapping both the fixed panel 14 and the movable sash 16. The fixed meeting rail is secured in position by inserting screws through the side rails 20 and into the screw channels 103 in the fixed meeting rail. The fixed panel 14 is then slid into position and specifically within the channels 30 in the side rails 20 and the channel 106 in the meeting rail 100. The top rail 22 is then moved into position such that the channel 92 encapsulates the upper edge of the fixed panel 14. The top rail 22 is secured to the side rails 20 using screws or other threaded fasteners inserted through the top rail and into the screw channels 52 on the side rails 20. Additionally, adhesive or heat welding can be used at all frame corners if desired. The lower sash assembly 16 is then interfitted into the channels 28 of the side rails 20 so that the side members 124 of the frame assembly interfit with the locking bar 61. The lower ends of the side rails 20 are preferably coated with adhesive &o improve the intersecurement of the side rails and the sill 24. The sill 24 is then secured to the side rails 20 by inserting screws (not shown) through the sill and into the screw channels 52 and 63 on the side rails 20 and the locking bars 61, respectively.

The screen 18 is installed in the frame 12, by positioning the screen 18 in the lower portion of the fixed glass channel 30. The upper portion of the screen 18 interfits with the fixed meeting rail 26 to maintain the upper edge of the screen in a desired plane. The lower edge of the screen 18 rests on the pair of spaced brackets 170 and more particularly between the thumb screw supporting body 180 and the leg 174 (see FIG. 3). At least one thumb screw 182 is tightened through a hole (not shown) in the screen frame to retain the screen in position.

To complete assembly of the unit for shipping, the interior and exterior frame pieces are placed in position about the side rails 20, the top rail 22, and the sill 24 so that the screw bosses 200 of the opposite trim pieces engage one another.

To install the unit, one or both of the interior and exterior trim pieces 190 is removed from the frame 12; and the frame, including the fixed panel 14, the movable sash 16, and the screen 18, is mounted within an opening formed in a door. After properly positioning the assembly within the door, the removed trim piece or pieces are reattached to the remainder of the frame assembly; and screws are inserted into the screw bosses to draw the trim pieces 190 together and thereby entrap the door light 10 within the door.

During its subsequent life and operation, the window 10 provides improved weather proofing over known constructions. First, the brackets 170 on the sill 24 space the screen 18 and the lower sash 16 off the sill even when the sash is in its lowermost or closed position. Consequently, water can drain under the screen 18 to improve drainage of the screen assembly. Further, the spacing is adequate to prevent capillary action from retaining water between the lower edge of the screen and the sill 24. Likewise, the spacing of the sash 16 above the sill wall 62 prevents capillary action therebetween from drawing water off the sill to the interior of the window assembly. The space also permits moisture to drain from beneath the sash 16 and ultimately beneath the screen 18.

As a second sealing feature, the frame trim pieces 190 both compress coextruded flaps about the entire periphery of the frame 12 to seal the frame trim pieces thereagainst. At the top rail 22 (FIG. 2) the inboard portions 196 of the frame trim pieces 190 compress the coextruded flaps 198 to form the weather seal. Similarly, the inboard portions 98 of the frame trim pieces compress the integral flaps 78 and 82 on the sill portion. The interior trim piece 190*a* compresses a single coextruded flap 44 on the side rails 20. The exterior frame trim piece 190*b* compresses the resilient flaps 60 on both sides of the pocket.

Third, the side rails 20 are nonaperatured throughout their height and width so that water cannot infiltrate to the core of the door. The unique and novel use of a separate locking bar 61 mounted on the nonaperatured side rail 20 enables notches to support the latches 162 in conventional fashion without requiring holes in the side rails.

The above description is that of a preferred embodiment of the invention. Various alterations and changes can be made without departing from the spirit and broader aspects of the invention as set forth in the appended claims which are to be interpreted in accordance with the principles of patent law including the doctrine of equivalents.

The embodiments of the invention in which an exclusive property or privilege is claimed are defined as follows:

1. A window comprising:

a frame including a sill;

a sash slidably supported by said frame and movable between a closed position adjacent said sill and an open position away from said sill;

a screen supported by said frame and having a lower edge adjacent said sill; and a plurality of bracket assemblies secured to said sill and spaced at discrete locations, each said bracket assembly including a first spacer spacing said sash a first distance above said sill, each said bracket assembly further including a second spacer spacing said screen a second distance above said sill, said first and second distances being sufficient to prevent capillary action from retaining water between said sill and said sash and said sill and said screen, respectively, each said bracket assembly further including registration means for registering said lower edge of said screen in a desired plane with respect to said sill.

2. A window as defined in claim 1 wherein at least one of said sash and said sill includes sealing means for providing a weather seal in an area separate from the space provided by said bracket assemblies.

3. A window comprising;

a sill;

a sash having a lower edge;

support means for supporting said sash for movement relative to said sill from a closed position wherein said lower sash edge is closely proximate said sill and open positions wherein said lower sash edge is varying distances from said sill; and spacer means for spacing said lower sash edge a distance from said sill when said sash is in the closed position, said spacer means comprising a plurality of spacers mounted on said sill and spaced from one another, said spacers being interposed between said sill and said sash, said distance being sufficient to prevent water from being drawn between said sash and said sill by capillary action.

4. A window as defined in claim 3 further comprising a screen having a lower edge proximate said sill, and wherein said spacer means includes means for spacing said lower screen edge a second distance from said sill, said second distance being sufficient to prevent capillary action from retaining water between said screen and said sill.

5. A window as defined in claim 4 wherein said spacer means further includes means for retaining said lower screen edge to a desired plane to register said screen with respect to said sill.

6. A window as defined in claim 3 further comprising sealing means for providing a weather seal between said sash and said sill.

7. A window comprising:

a frame having a sill assembly;

a screen assembly supported by said frame, said screen assembly having a lower edge; and spacer means for spacing said lower edge of said screen assembly a distance above said sill assembly, said spacer means comprising a plurality of spacers mounted on said sill and spaced from one another, said spacers being interposed between said sill and said sash, said distance being sufficient to permit water to drain from between said lower screen edge and said sill assembly and to prevent water from being retained between said lower screen edge and said sill assembly.

8. A window as defined in claim 7 further comprising a sash supported by said frame and movable from a closed position adjacent said sill assembly to a plurality of open positions, wherein said spacer means includes means for spacing said lower edge of said sash a second distance above said sill assembly defining an open space therebetween, said second distance being sufficient to prevent water from being drawn by capillary action between said sash and said sill.

9. A window as defined in claim 7 wherein said spacer means further includes means for retaining said lower screen edge in a desired plane.

10. A window comprising:

a sill;

a screen having a lower frame member; and a plurality of spaced screen retention brackets mounted on said sill and supporting said screen, said brackets including a base secured to said sill, and exterior and interior legs extending upwardly therefrom, said lower frame member fitting between said legs, said bracket further including a threaded member extending through said interior leg and bearing against said lower frame member to releasably secure said frame member between said exterior leg and said threaded member.

11. A window as defined in claim 10 wherein said brackets space said screen frame member above said sill a distance preventing water from being retained by capillary action therebetween.

12. A window as defined in claim 10 wherein said bracket further includes a third spacing means for preventing a slidable sash from directly engaging said sill.

* * * * *

UNITED STATES PATENT AND TRADEMARK OFFICE

CERTIFICATE OF CORRECTION

PATENT NO. : 4,872,498

DATED : October 10, 1989

INVENTOR(S) : David A. DeBlock et al

It is certified that error appears in the above-identified patent and that said Letters Patent is hereby corrected as shown below:

Column 8, line 50
First occurrence of "to" should be --in--.

Signed and Sealed this

Eighteenth Day of September, 1990

*Attest:*

HARRY F. MANBECK, JR.

*Attesting Officer*

*Commissioner of Patents and Trademarks*